US009033263B2

(12) United States Patent
Rackwitz

(10) Patent No.: US 9,033,263 B2
(45) **Date of Patent: *May 19, 2015**

(54) FUEL INJECTION NOZZLE WITH FILM-TYPE FUEL APPLICATION

(75) Inventor: Leif Rackwitz, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 485 days.

This patent is subject to a terminal disclaimer.

(21) Appl. No.: 10/967,320

(22) Filed: Oct. 19, 2004

(65) Prior Publication Data

US 2005/0133642 A1 Jun. 23, 2005

(30) Foreign Application Priority Data

Oct. 20, 2003 (DE) ..... 103 48 604

(51) Int. Cl.
*B05B 7/10* (2006.01)
*F23D 11/10* (2006.01)
*F23R 3/28* (2006.01)

(52) U.S. Cl.
CPC ..... *F23D 11/106* (2013.01); *F23D 11/107* (2013.01); *F23D 2900/11101* (2013.01); *F23R 3/28* (2013.01)

(58) Field of Classification Search
CPC ..... F23D 11/10; F23D 11/106; F23D 11/107; F23D 11/12; F23D 2900/11101; F23R 3/28
USPC ..... 239/400, 406, 404, 398, 405; 60/737, 60/742, 743, 735, 740, 739, 637, 748
See application file for complete search history.

(56) References Cited

U.S. PATENT DOCUMENTS

| | | | | |
|---|---|---|---|---|
| 3,866,413 | A * | 2/1975 | Sturgess | 60/742 |
| 3,930,369 | A * | 1/1976 | Verdouw | 60/737 |
| 3,937,011 | A | 2/1976 | Caruel | |
| 3,955,361 | A * | 5/1976 | Schirmer et al. | 60/736 |
| 3,980,233 | A * | 9/1976 | Simmons et al. | 239/400 |
| 4,141,213 | A * | 2/1979 | Ross | 60/39.821 |
| 4,170,108 | A * | 10/1979 | Mobsby | 60/740 |
| 4,218,020 | A * | 8/1980 | Reider | 239/406 |
| 4,425,755 | A | 1/1984 | Hughes | |
| 4,974,416 | A * | 12/1990 | Taylor | 60/737 |
| 5,251,447 | A * | 10/1993 | Joshi et al. | 60/737 |

(Continued)

FOREIGN PATENT DOCUMENTS

| | | |
|---|---|---|
| DE | 3913124 | 6/1989 |
| DE | 3819898 | 12/1989 |

(Continued)

OTHER PUBLICATIONS

German Search Report from corresponding application dated Apr. 14, 2010.

(Continued)

*Primary Examiner* — Christopher Kim
(74) *Attorney, Agent, or Firm* — Timothy J. Klima; Shuttleworth & Ingersoll, PLC

(57) ABSTRACT

A fuel injection nozzle for a gas turbine combustion chamber with a film applicator (1) is provided with several fuel openings (2). Center axes (5) of the fuel openings (2) through the film applicator (1), with regard to their radial orientation, are essentially parallel to the main flow direction (6) of the air.

14 Claims, 9 Drawing Sheets

(56) References Cited

U.S. PATENT DOCUMENTS

| | | | | |
|---|---|---|---|---|
| 5,303,554 | A | 4/1994 | Faulkner | |
| 5,351,475 | A * | 10/1994 | Ansart et al. | 60/804 |
| 5,351,477 | A * | 10/1994 | Joshi et al. | 60/39.463 |
| 5,373,693 | A * | 12/1994 | Zarzalis et al. | 60/39.23 |
| 5,479,781 | A | 1/1996 | Fric | |
| 5,505,045 | A | 4/1996 | Lee | |
| 5,673,551 | A | 10/1997 | Dobbeling | |
| 5,680,766 | A * | 10/1997 | Joshi et al. | 60/746 |
| 5,778,676 | A * | 7/1998 | Joshi et al. | 60/746 |
| 5,816,049 | A * | 10/1998 | Joshi | 60/737 |
| 5,966,937 | A * | 10/1999 | Graves | 60/748 |
| 6,068,470 | A * | 5/2000 | Zarzalis et al. | 431/187 |
| 6,070,411 | A * | 6/2000 | Iwai et al. | 60/737 |
| 6,119,459 | A * | 9/2000 | Gomez et al. | 60/748 |
| 6,152,726 | A | 11/2000 | Ruck | |
| 6,360,525 | B1 * | 3/2002 | Senior et al. | 60/776 |
| 6,363,726 | B1 * | 4/2002 | Durbin et al. | 60/748 |
| 6,474,569 | B1 | 11/2002 | Brundish | |
| 6,532,726 | B2 * | 3/2003 | Norster et al. | 60/39.281 |
| 6,609,377 | B2 * | 8/2003 | Durbin et al. | 60/748 |
| 6,688,109 | B2 * | 2/2004 | Hein | 60/748 |
| 6,799,427 | B2 * | 10/2004 | Calvez et al. | 60/737 |
| 6,968,255 | B1 * | 11/2005 | Dimaridis et al. | 700/131 |
| 6,986,255 | B2 * | 1/2006 | Smith et al. | 60/776 |
| 7,086,234 | B2 * | 8/2006 | Doerr et al. | 60/776 |
| 7,546,734 | B2 * | 6/2009 | Dorr et al. | 60/737 |
| 7,669,421 | B2 * | 3/2010 | Saitoh et al. | 60/748 |
| 2002/0011064 | A1 | 1/2002 | Crocker | |
| 2002/0174656 | A1 * | 11/2002 | Hein | 60/737 |
| 2003/0089112 | A1 * | 5/2003 | Durbin et al. | 60/746 |
| 2003/0093997 | A1 * | 5/2003 | Stalder et al. | 60/737 |
| 2004/0003596 | A1 * | 1/2004 | Chin et al. | 60/737 |
| 2004/0040311 | A1 * | 3/2004 | Doerr et al. | 60/776 |
| 2005/0039456 | A1 * | 2/2005 | Hayashi | 60/737 |

FOREIGN PATENT DOCUMENTS

| | | |
|---|---|---|
| DE | 4316474 | 11/1994 |
| DE | 4424597 | 1/1996 |
| DE | 19532264 | 3/1997 |
| DE | 19729246 | 1/1999 |
| EP | 0724115 | 7/1996 |
| EP | 0994300 | 4/2000 |
| EP | 1331441 | 7/2003 |
| GB | 1420027 | 1/1976 |
| GB | 2291179 | 1/1996 |
| GB | 2327120 | 1/1999 |

OTHER PUBLICATIONS

European Search Report dated Jan. 18, 2012 for counterpart European patent application.

* cited by examiner

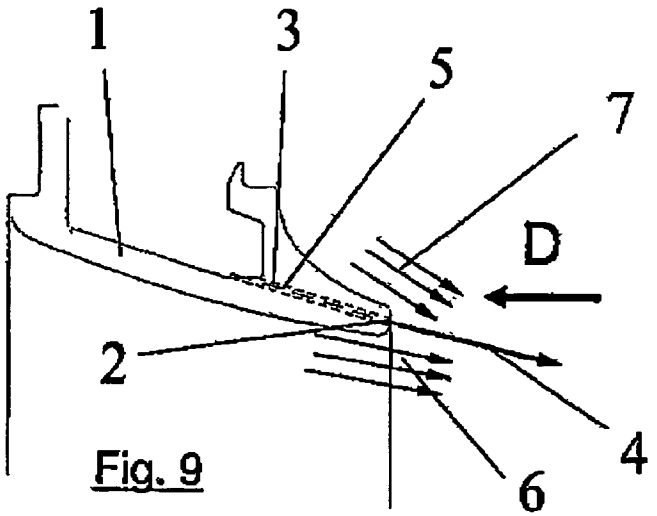
Fig. 9
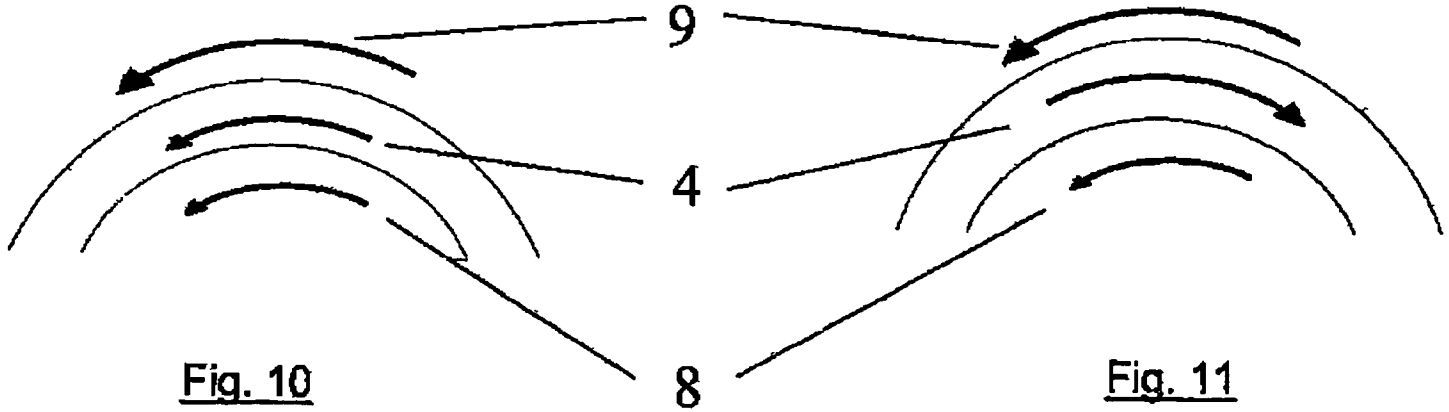
Fig. 10
Fig. 11

FUEL INJECTION NOZZLE WITH FILM-TYPE FUEL APPLICATION

This application claims priority to German Patent Application DE10348604.6 filed Oct. 20, 2003, the entirety of which is incorporated by reference herein.

BACKGROUND OF THE INVENTION

This invention relates to a fuel injection nozzle. More particularly, this invention relates to a fuel injection nozzle for a gas turbine combustion chamber with a film applicator provided with several fuel openings.

A great variety of methods is used to prepare the fuel-air mixture in gas turbine combustion chambers, with distinction being basically made between their application to stationary gas turbines or aircraft gas turbines and the respective specific requirements. However, in order to reduce pollutant emissions, in particular nitrogen oxide emissions, the fuel must generally be premixed with as much air as possible to obtain a lean combustion state, i.e. one characterized by air excess. Such a mixture is, however, problematic since it may affect stabilizing mechanisms in the combustion process.

FIG. 1 shows, in schematic sectional side view, a combustion chamber 10 and the corresponding fuel injection. Shown in the figure is a central supply of fuel in the burner axis 22 and a decentral supply of fuel 23 almost vertically to the burner axis. Arrowheads 11 and 12 schematically indicate the supply of air to an inner swirler 14 and to an outer swirler 15. The fuel-air mixture 13 enters the combustion chamber 10 in the usual manner.

Combustion is almost exclusively stabilized by the effect of swirling air, enabling the partly burnt gases to be re-circulated. Fuel is frequently introduced centrally by means of a nozzle arranged on the center axis of the atomizer. Here, fuel is in many cases injected into the airflow with considerable overpressure to achieve adequate penetration and to premix it with as much air as possible. These pressure atomizers are intended to break up the fuel directly. However, some designs of injection nozzles are intended to spray the fuel as completely as possible onto an atomizer lip. The fuel is accelerated on the atomizer lip by the airflow, broken up into fine droplets at the downstream end of this lip and mixed with air. Another possibility to apply the fuel onto this atomizer lip is by way of a so-called film applicator, in which case the fuel is distributed as uniformly as possible in the form of a film.

A further possibility to mix the fuel as intensely as possible with a great quantity of air is by decentral injection (FIG. 2) from the outer rim of a flow passage formed by a film applicator 1, which carries the major quantity of air. This can be accomplished from an atomizer lip, but also from the outer nozzle contour. Different to a film applicator, this type of injection is characterized by a defined penetration of the fuel into the main airflow.

Both, the injection of fuel by means of a central nozzle or a pressure atomizer and the introduction as a film by way of a film applicator are to be optimized such that a maximum amount of the air passing the atomizer, if possible the entire air, is homogeneously mixed with fuel prior to combustion. Characteristic of a low-pollutant, in particular low-nitrogen oxide combustion is the preparation of a lean fuel-air mixture, i.e. one premixed with air excess. However, this entails fuel nozzles whose flow areas are large enough to enable the high quantity of air to be premixed with fuel. Due to the size of these fuel nozzles and, if central injection is used, the limited ability of the fuel jets or sprays to penetrate the constantly increasing sizes of air passages and, thus, to provide a homogenous distribution of the fuel-air mixture, novel concepts of fuel injection and pre-mixture are required.

Homogenous distribution and introduction of fuel in large airflow passages calls for decentral injection from a maximum number of fuel openings to be arranged on the airflow passage walls. Due to their great number, however, the openings will be very small, as a result of which they may be blocked or clogged by contaminated fuel. Since these burners are frequently cut in at higher engine loads, blockage may also be caused by fuel degradation products if, after intermediate or high-load operation, burner operation via these fuel openings is deactivated and the fuel remaining in the fuel nozzle is heated up and degraded.

Typical of the fuel nozzles is, in many cases, a very irregular velocity and mass flow distribution in the radial direction. Due to the swirling air, which is required to stabilize the subsequent combustion process, the local airflows are at maximum in the area of the radially outer limiting wall. If fuel is introduced into the airflow via a small number of openings, the circumferential homogeneity of the fuel in the air will, on the one hand, be affected and, on the other hand, the fuel can penetrate very deeply into the flow and unintentionally mix and vaporize in regions in which air is not sufficiently available. This may also occur with decentral injection.

BRIEF SUMMARY OF THE INVENTION

The present invention, in a broad aspect, provides a fuel injection nozzle of the type specified at the beginning which, while being simply designed and operationally reliable, ensures uniform mixture of fuel and air.

It is a particular object of the present invention to provide solution to the above problems by a combination of the features expressed herein. Further advantageous embodiments of the present invention will be apparent from the description below.

Accordingly, the present invention provides for an essentially parallel arrangement to the main airflow direction of the center axes of the fuel openings through the film applicator, with regard to their radial orientation. This essentially parallel arrangement may deviate from absolute parallelism to an extent which is defined by a given acute angle. For purely constructional reasons, completely parallel fuel injection is not always possible. In accordance with the present invention, it is crucial that fuel injection has a large axial component, as a result of which the fuel will not be injected radially.

The fuel openings can be provided on a radially inner wall of the film applicator, but can also exit at a trailing edge of the film applicator.

The film applicator or the area of fuel injection, respectively, is preferably arranged between two swirlers.

It is particular advantageous if the fuel openings are additionally inclined in the direction of the air swirl, i.e. have an additional circumferential component. This component can be co-rotational or contra-rotational. Furthermore, the present invention provides for a single-row, multi-row, in-line or staggered arrangement of the fuel openings.

For even better mixture of air and fuel, the film applicator according to the present invention can also be of the lamellar design.

BRIEF DESCRIPTION OF THE DRAWINGS

The present invention is more fully described in the light of the accompanying drawings showing preferred embodiments. In the drawings, FIG. 9 is a clarification, analogically to FIG. 7, of the explanations of FIGS. 10 and 11, FIG. 10 is a view in the direction of arrowhead D of FIG. 9, showing the outer and inner air swirl and the fuel swirl in co-rotation, FIG. 11 is a representation, analogically to FIG. 10, of a fuel injection in contra-rotation to the airflow.

DETAILED DESCRIPTION OF THE INVENTION

Figure 1:
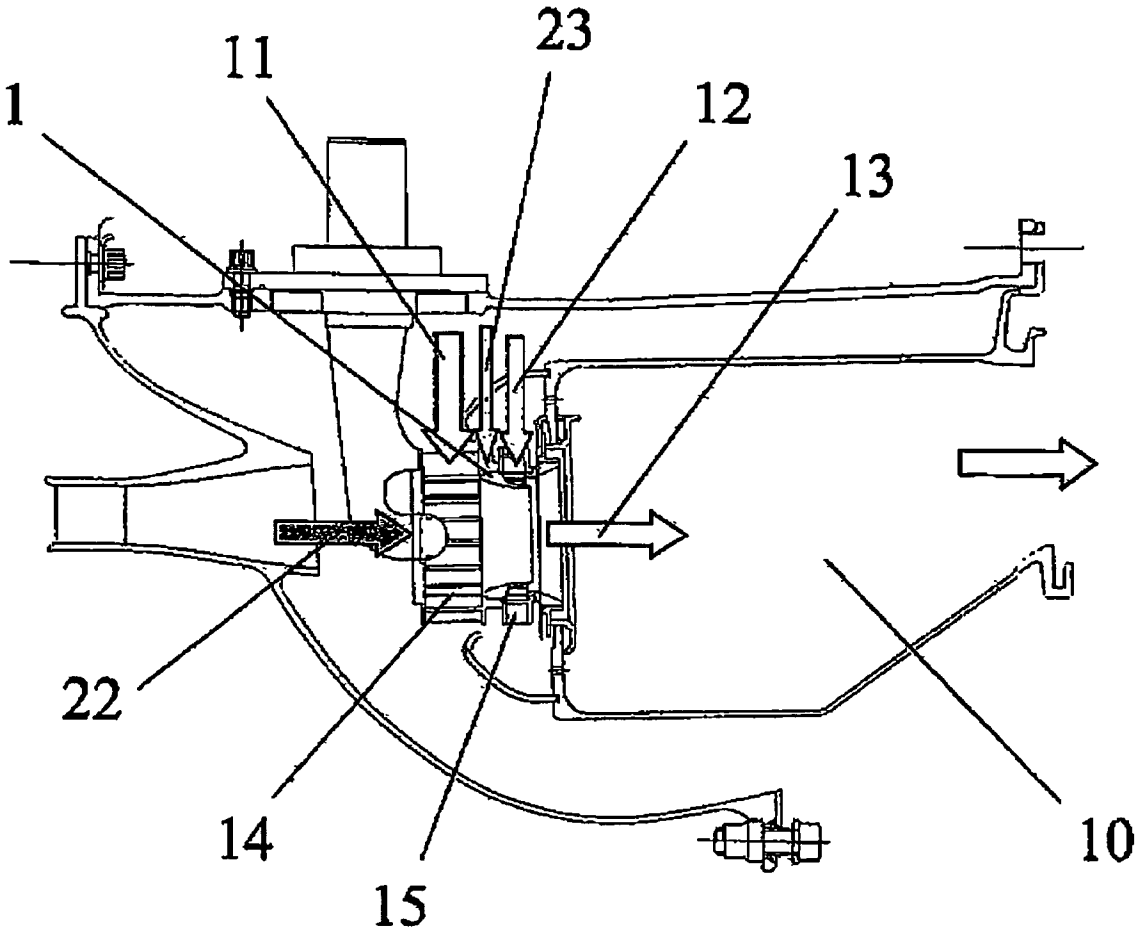
FIG. 1 shows, in schematic representation, a longitudinal section through a gas turbine combustion chamber according to the present invention, FIGS. 2*a* and 2*b* (Prior Art) show a fuel nozzle with decentral, inward fuel injection according to the state of the art, with the detail of FIG. 2*b* providing further clarification, FIGS. 3*a* and 3*b* with FIG. 3*b* being a detail figure of FIG. 3*a*, show a first embodiment of a fuel nozzle with decentral flow-oriented fuel injection in accordance with the present invention, analogically to the representation in FIG. 2, FIGS. 4*a* and 4*b* with FIG. 4*b* being a detail figure of FIG. 4*a*, show a further embodiment of a fuel nozzle with decentral fuel injection at the trailing edge of a film applicator, again analogically to FIGS. 2 and 3.

In the figures, like items are identified with like reference numerals.

Figure 3B:
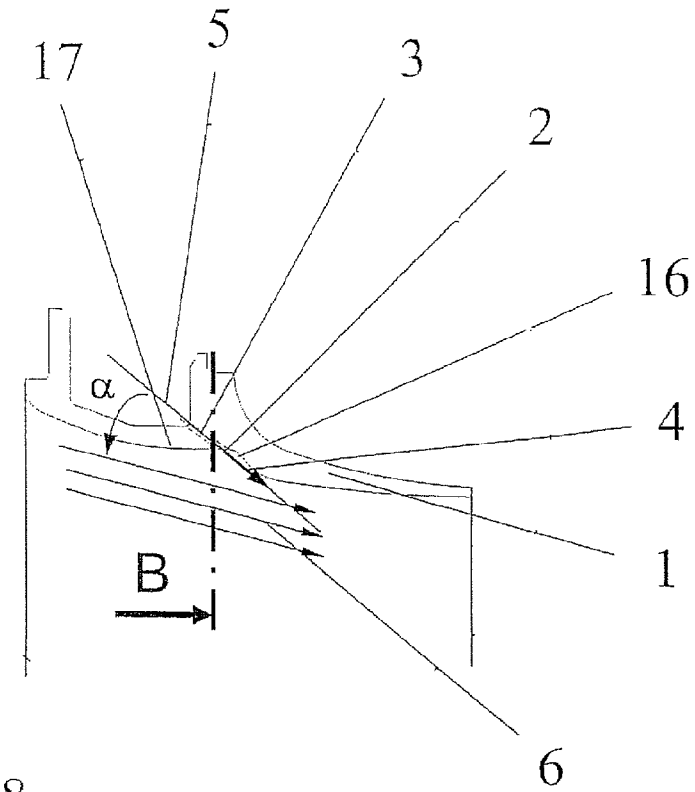
Figure 3A:
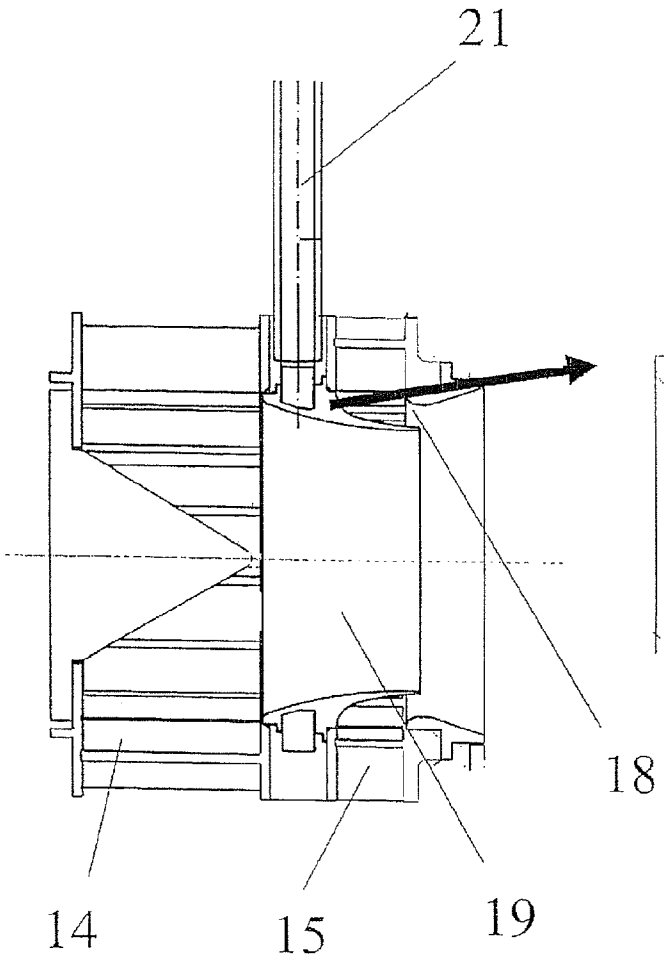

FIGS. 3*a* and 3*b* show, in simplified representation, a section through a film applicator 1 in accordance with the present invention, with fuel openings 2, in particular fuel holes 3, being illustrated whose center axes 5 are inclined at an angle α to the main flow direction 6 (near-wall flow direction in the inner swirl channel).

Reference numeral 16 indicates a yawing wall element of the film applicator 1, reference numeral 17 an aerodynamically conformal film applicator surface. Reference numeral 21 indicates a fuel line.

With the present invention, unintentional penetration of liquid fuel into areas with low flow velocities and the resultant non-uniform mixture of fuel and air are avoided. FIG. 3 shows a proposed embodiment. Here, the fuel is not injected radially inward, i.e. with a high radial component of the exit velocity of the fuel, into an inner swirl channel. Rather, a high axial component of the exit velocity of the fuel is provided for in the proposed concept, with the fuel being injected approximately in parallel with the main flow direction of the inner swirl channel. FIG. 3 schematically shows the fuel openings and the ejection of the fuel.

Via the openings illustrated, the fuel is initially injected at an angle α inclined to the airflow direction, this angle being acute. In a preferred embodiment of the invention, the angle α is set at between 0° and 50°, inclusive, as well as within any range within that range. For instance, one embodiment is contemplated having an angle α of between 5° and 50°, inclusive, while another is contemplated having an angle α of between 10° and 30°, inclusive. Also contemplated are embodiments having an angle α of between 0° and 10°, inclusive, and between 0° and 5°, inclusive, as well as an embodiment that is essentially parallel.

Figures 2A, 2B:
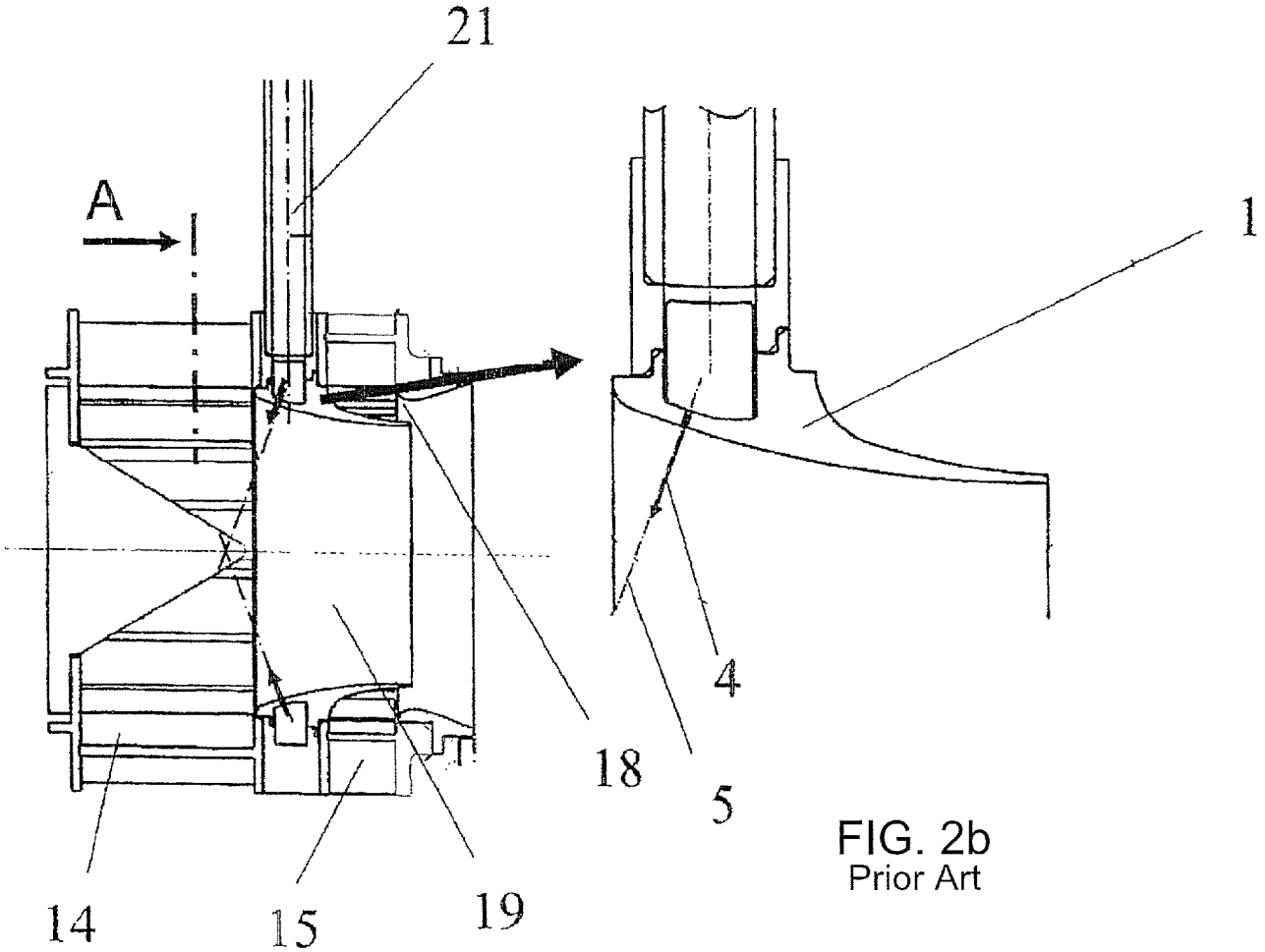
FIG. 2b Prior Art
FIG. 2a Prior Art

Furthermore, the fuel openings can also be arranged circumferentially in co-rotation with or in contra-rotation to the airflow, respectively. The inclination enables the number of fuel openings to be reduced; at the same time, with the regions of high air velocity and, hence, high local air mass flows being present in the near-wall area of the outer wall of the swirled airflow, the depth of penetration is controlled. Upon ejection, the liquid fuel arrives, after a short route, at the surface of a yawing wall element of the film applicator on which a distribution of the film, or the formation of a fuel film, takes place in axial and in circumferential direction (see FIG. 3). By virtue of the high acceleration of the flow near the wall of the film applicator, the fuel film formed is further downstream held close to the boundary layer of the subsequent contour of the film applicator. Owing to an aerodynamically favourable, i.e. low-loss design of the film applicator geometry upstream of the fuel exit holes, the mixture of the fuel with the swirled air takes place as early as at the point of fuel injection. Furthermore, the acceleration of the airflow is used to prevent non-vaporized fuel droplets from making their way to the burner axis. Contrary to the known fuel nozzles with decentral fuel injection (see FIG. 2), the present invention provides for the undisturbed development of a fuel film along the film applicator. For design reasons, the embodiment shown in FIG. 3 may also be provided as a split design. The shape of the openings may also be varied, i.e. round, elliptical etc. The design according to the present invention provides for the development of a fuel film in a radially very confined flow layer. The fuel film will detach at the trailing edge of the film applicator and be homogeneously mixed by the presence of accelerated and swirled air from the outer and inner flow channel.

Figure 4B:
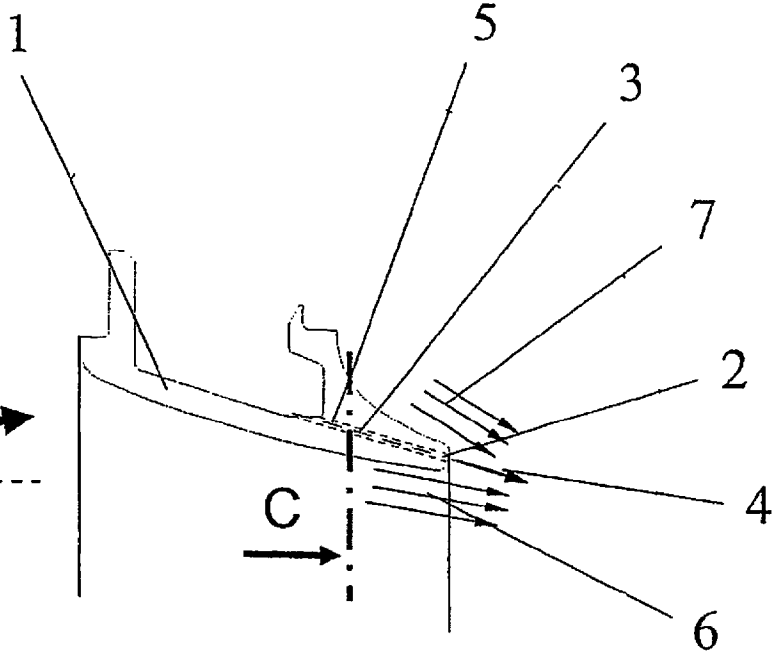
Figure 4A:
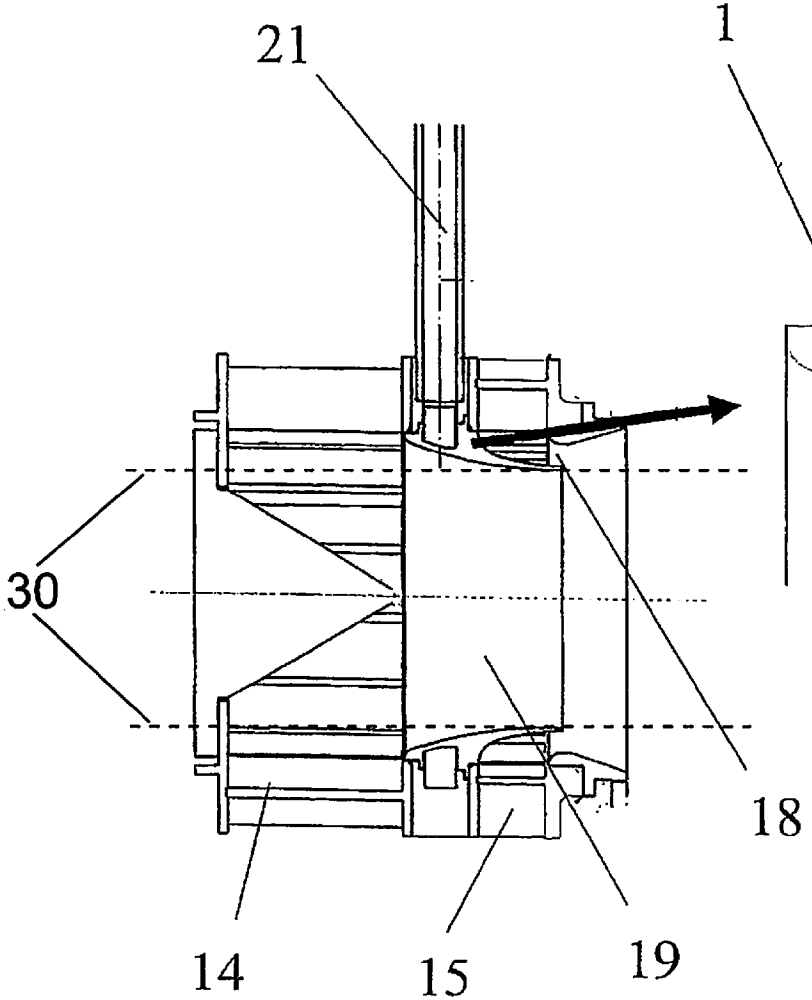
Figures 5, 6:
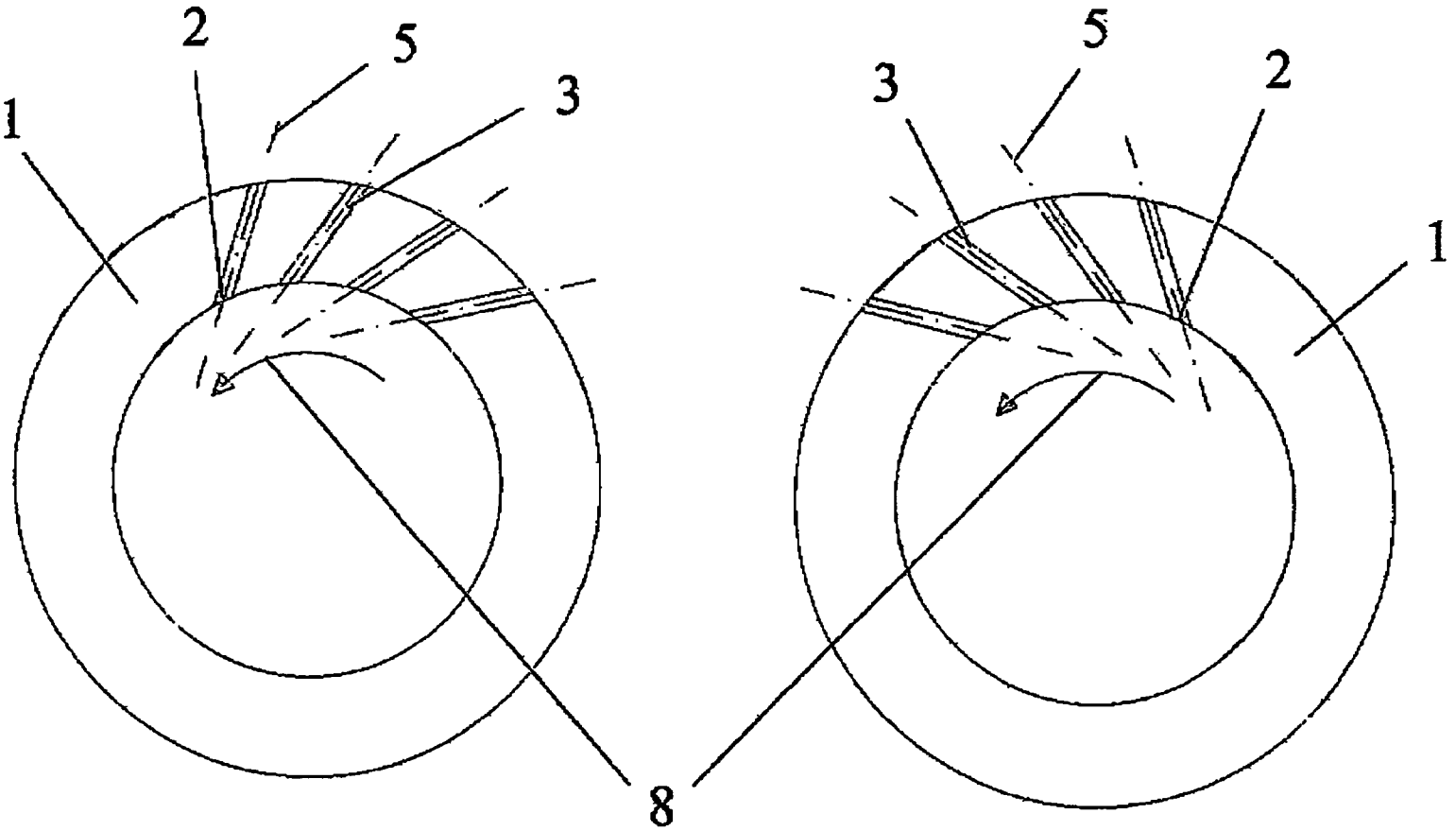
FIG. 5 is a sectional front view in the direction of arrowheads A, B and C of FIGS. 2 to 4, showing fuel injection in co-rotation with the airflow.
FIG. 6 is a representation, analogically to FIG. 5, showing fuel injection in contra-rotation to the airflow.
Figures 7, 8:
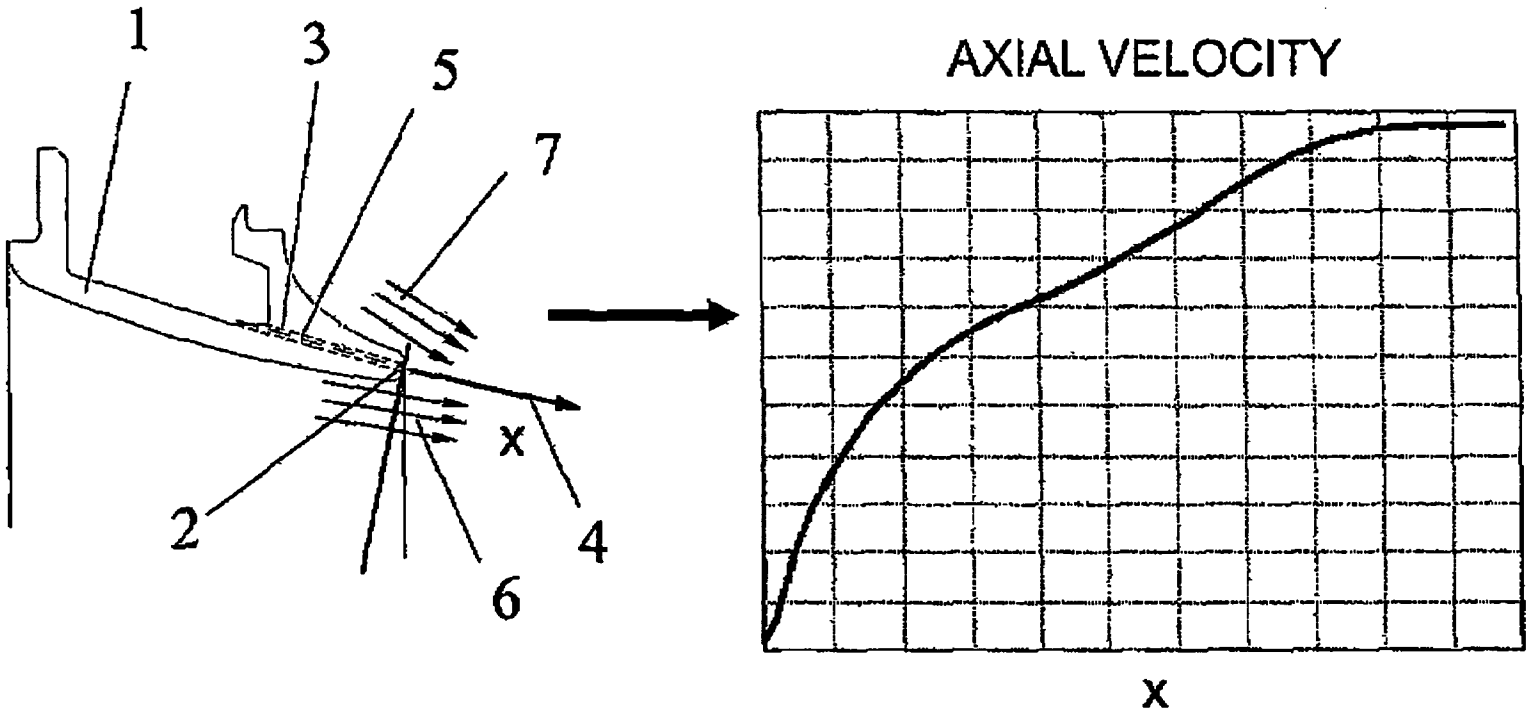
FIG. 7 is a partial side view, analogically to FIG. 4.
FIG. 8 is a graph of the axial air velocity vs. a local coordinate x defining the axial distance from the trailing edge of the fuel injection nozzle.
Figure 13:
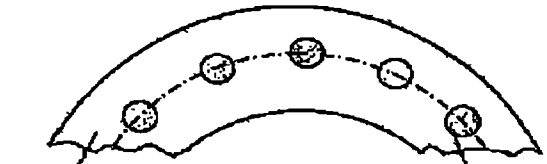
FIG. 13 is a view in the direction of arrowhead D as per FIG. 12, showing a single-row arrangement of fuel holes.
Figure 14:
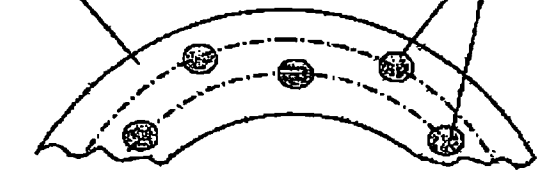
FIG. 14 is a representation, analogically to FIG. 13, showing a staggered arrangement of the fuel holes, and FIGS. 15*a* and 15*b* with FIG. 15*b* being a detail figure of FIG. 15*a*, show a further embodiment with a lamellar design of the film applicator surface.
Figure 12:
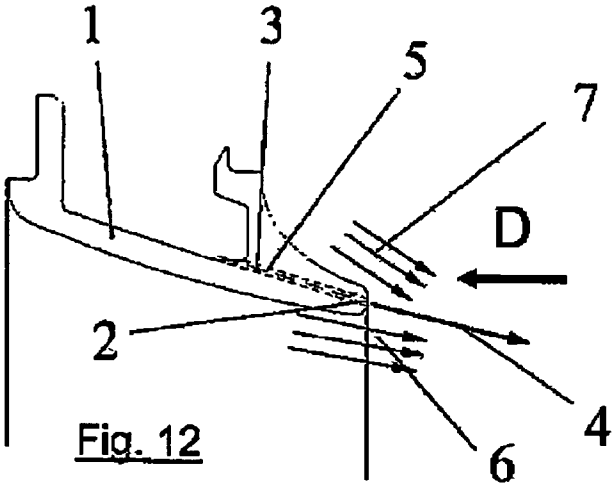
FIG. 12 is a clarification of the representations in FIGS. 13 and 14.

A further embodiment of the present invention provides for injection of the fuel at the trailing edge of a flow divider between two swirlers (FIGS. 4*a* and 4*b*). The velocity maxima of the air accelerated and swirled in the swirlers lie near the wall of the flow divider provided, i.e. in the outer flow of the boundary layer on either side of the flow divider. In the wake of the flow divider, the air is continuously accelerated and highly swirled. FIG. 4*a* shows an (imaginary) cylinder 30 established by an outer circumference of the annular flow divider (film applicator 1) at its downstream-most trailing edge and being parallel to an axis of the nozzle. At least a portion of the outer swirl channel 18 is directly open to the combustion chamber 10 outside of the cylinder to have a direct and unobstructed path to the combustion chamber 10. In this context, FIGS. 7 and 8 show the axial acceleration of the flow in the wake of the trailing edge of the flow divider, with x being the axial distance from the trailing edge of the flow divider. CFD investigations have shown that a very homogenous fuel-air mixture in the wake area of the flow divider can be obtained with this embodiment, with the fuel being introduced in axially accelerated regions of flow. With, on average, low temperatures, very low nitrogen oxide emissions are obtainable. This embodiment is primarily characterized by the avoidance of significant radial velocity components of the Injected fuel, as a result of which specific droplet classes are basically hindered from making their way into the vicinity of the burner axis, i.e. into regions with low flow velocities. Owing to the shear layer forming between the swirled airflows, a very intense mixture between fuel and air occurs at high relative velocities. Different variants of injection are shown in FIGS. 9 to 14. The fuel 4 can be injected both co-rotationally with and contra-rotationally to the inner air swirl 8 or outer air swirl 9, respectively. In addition, the fuel holes can be arranged single-row or multi-row, in-line or staggered relative to each other.

Figure 15B:
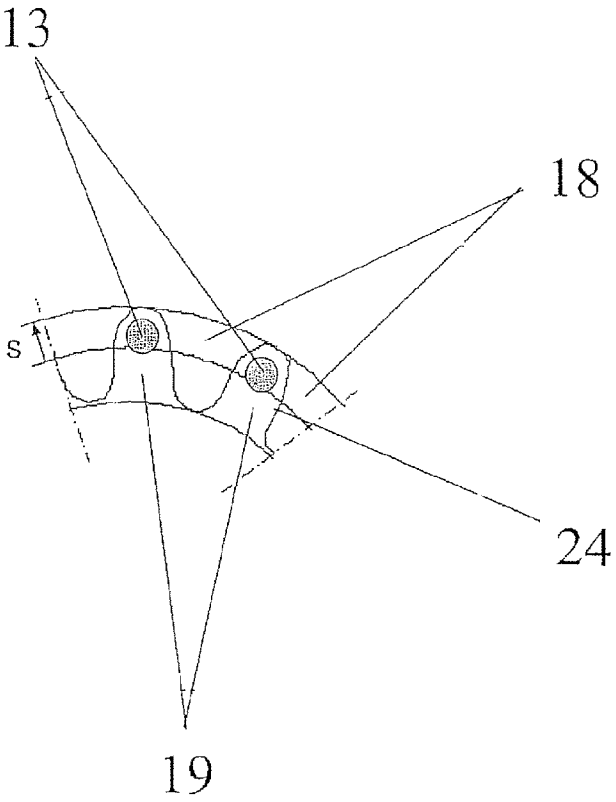
Figure 15A:
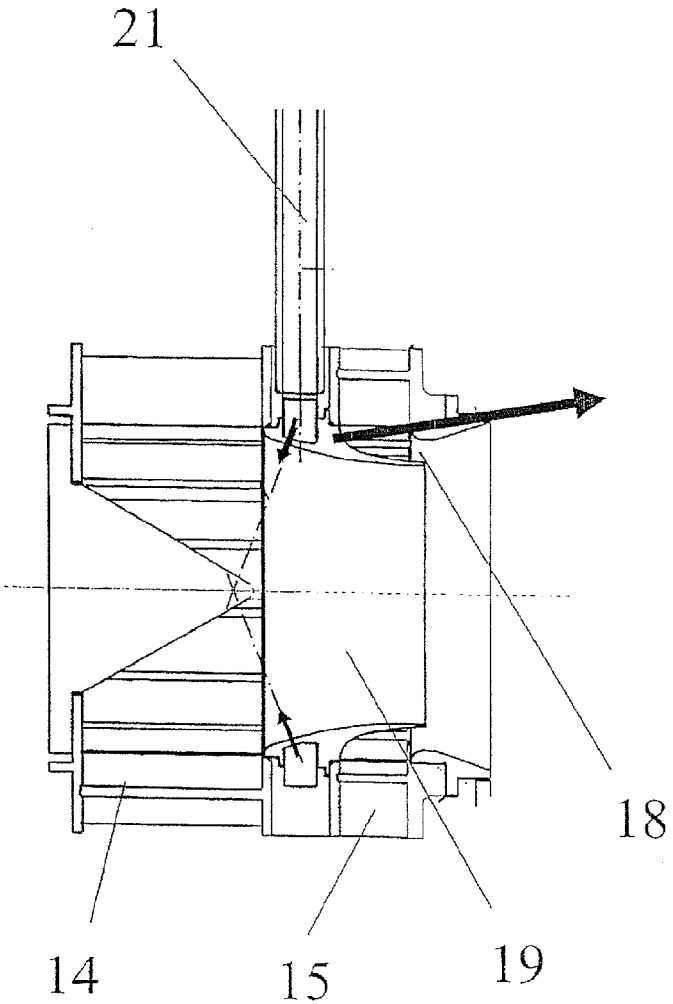

A further embodiment of the present invention provides for a lamellar design of the film applicator. For this, FIGS. 15*a* and 15*b* schematically illustrate a respective variant of the film applicator. Similarly to the low-loss design of the exhaust gas mixer of an aircraft engine, it is attempted to combine different air mass flows into a total flow with minimum loss. However, in the burner concept proposed, the mixing process shall lead to an improved mixture by way of three-dimensional mixing of a swirled airflow with an airflow which is already partly premixed with fuel. By virtue of the shape, the swirled air from the outer channel periodically enters the inner channel. The injection of fuel into the inner or outer swirl channel, respectively, leads to the formation of a fuel-air mixture downstream of the film applicator, with the dwell time being increased. Again by virtue of the shape, this mixture can penetrate into the inner swirl channel. Therefore, within a suitable "deflection"s up to max. ±15 percent from the nominal centerline of the trailing edge of the film applicator, a flow layer can be produced in which a very intense mixture of fuel and air from the inner channel and the admixture of pure air from the outer swirl channel, or vice versa, can be obtained. Thus, a very homogenous mixture can be produced which provides for a uniform temperature field with low absolute temperatures and low nitrogen oxide values. A further characteristic of the embodiment shown in FIGS. 15*a* and 15*b* can be a circumferentially conformal helical geometry of the lamellar film applicator, in which the lamellar geometry is adapted with appropriate effectiveness to the air swirl near the wall of the film applicator.

The advantage of the present invention is a practical solution to the problem of homogeneously premixing fuel with air, while achieving a defined, not too deep penetration of the fuel into the airflow with a minimum number of relatively large fuel openings. The general objective is the reduction of nitrogen oxide emission of the gas turbine combustion chamber by means of a robust, technically feasible fuel injection configuration.

LIST OF REFERENCE NUMERALS

1 Film applicator
2 Fuel opening
3 Fuel hole
4 Fuel flow direction
5 Center axis of fuel openings
6 Near-wall main flow direction (inner swirl channel)
7 Near-wall main flow direction (outer swirl channel)
8 Air swirl (inner swirl channel)
9 Air swirl (outer swirl channel)
10 Combustion chamber
11 Air supply (inner swirl channel)
12 Air supply (outer swirl channel)
13 Fuel-air mixture
14 Inner swirler
15 Outer swirler
16 Wall element
17 Film applicator surface
18 Outer swirl channel (air)
19 Inner swirl channel (air)
20 Film applicator surface
21 Fuel line
22 (Central) fuel supply
23 (Decentral) fuel supply
24 Lamellar film applicator

What is claimed is:

1. A fuel injection nozzle for a gas turbine combustion chamber, comprising:

an inner air swirler for providing an inner flow of air through an inner swirl channel;

an outer air swirler for providing an outer flow of air through an outer swirl channel, the outer swirl channel being a radially outermost air channel of the nozzle;

an annular flow divider directly separating the inner and outer flows of air, the flow divider including a downstream-most trailing edge and a radially outer surface and a radially inner surface upstream of and adjacent to the trailing edge, the radially outer surface having a concave shape facing away from a center axis of the fuel injection nozzle in an axial cross-section, the radially inner surface having a convex shape facing toward the center axis in the axial cross-section; the radially outer surface and the radially inner surface converging together in a downstream direction to form a tapering shape of the flow divider toward the trailing edge in the axial cross-section; the converging radially outer surface and radially inner surface providing for converging of the inner and outer flows of air downstream of the trailing edge of the flow divider; the flow divider having a plurality of fuel openings positioned around a circumference of the flow divider and having respective center axes, wherein the center axes of the fuel openings are set in the downstream direction and wherein the fuel openings are arranged immediately on and through the trailing edge between the converging inner and outer flows of air to inject fuel in the downstream direction of the nozzle directly into a shear layer formed between the inner and outer flows of air, the injection of the fuel into the shear layer creating a mixture between the fuel and air; the fuel openings positioned on the trailing edge to inject the fuel into the position where the inner and outer flows of air converge downstream of the trailing edge;

at least a portion of the outer swirl channel being directly open to the combustion chamber outside of a cylinder established by an outer circumference of the annular flow divider at the downstream-most edge and being parallel to an axis of the nozzle such that at least a portion of the outer flow of air has a direct and unobstructed path to the combustion chamber.

2. A fuel injection nozzle in accordance with claim 1, wherein the film applicator is of lamellar design.

3. A fuel injection nozzle in accordance with claim 2, wherein the film applicator has a helical geometry in a circumferential direction.

4. A fuel injection nozzle in accordance with claim 1, wherein the fuel openings, with regard to a circumferential orientation of their center axes, are arranged co-rotationally to an inner air swirl or an outer air swirl, respectively.

5. A fuel injection nozzle in accordance with claim 1, wherein the fuel openings, with regard to a circumferential orientation of their center axes, are arranged contra-rotationally to an inner air swirl or an outer air swirl, respectively.

6. A fuel injection nozzle in accordance with claim 1, wherein the fuel openings are arranged in a single row.

7. A fuel injection nozzle in accordance with claim 1, wherein the fuel openings are arranged in multiple rows.

8. A fuel injection nozzle in accordance with claim 7, wherein the fuel openings are arranged in lines with one another.

9. A fuel injection nozzle in accordance with claim 7, wherein the fuel openings are staggered relative to each other.

10. A fuel injection nozzle in accordance with claim 1, wherein the center axes of the fuel openings, with regard to their axial orientation, are arranged at an angle $\alpha$ to a near-wall flow direction of the air of between 10° and 30°, inclusive.

11. A fuel injection nozzle in accordance with claim 1, wherein the center axes of the fuel openings, with regard to their axial orientation, are arranged at an angle $\alpha$ to a near-wall flow direction of the air of between 0° and 10°, inclusive.

12. A fuel injection nozzle in accordance with claim 1, wherein angles of the center axes of the fuel openings are set to bisect an angle between the inner and outer flows of air at the downstream-most edge of the flow divider.

13. A fuel injection nozzle in accordance with claim 12, wherein the inner swirl channel is directly open to the combustion chamber at an inner circumference of the downstream-most edge in a direction parallel to the axis of the nozzle.

14. A fuel injection nozzle in accordance with claim 1, wherein the inner swirl channel is directly open to the combustion chamber at an inner circumference of the downstream-most edge in a direction parallel to the axis of the nozzle.

* * * * *